US008561956B2

(12) United States Patent
Tao

(10) Patent No.: US 8,561,956 B2
(45) Date of Patent: Oct. 22, 2013

(54) CORNER PROTECTOR

(75) Inventor: Jason J. Tao, Rowland Heights, CA (US)

(73) Assignee: Kohburg, Inc., Pomona, CA (US)

( * ) Notice: Subject to any disclaimer, the term of this patent is extended or adjusted under 35 U.S.C. 154(b) by 144 days.

(21) Appl. No.: 13/078,191

(22) Filed: Apr. 1, 2011

(65) Prior Publication Data

US 2011/0278416 A1 Nov. 17, 2011

(30) Foreign Application Priority Data

May 11, 2010 (CN) ..... 2010 2 0201619 U

(51) Int. Cl.
*A47B 95/00* (2006.01)

(52) U.S. Cl.
USPC ..... 248/345.1; 248/100; 248/217.1; 248/220.1; 52/630

(58) Field of Classification Search
USPC ..... 248/345.1, 100, 99, 119, 120, 212, 217; 52/630, 288, 716, 829; 144/347; 264/328.1
See application file for complete search history.

(56) References Cited

U.S. PATENT DOCUMENTS

| | | | | | |
|---|---|---|---|---|---|
| 1,936,113 | A | * | 11/1933 | Jelliffe | 248/188.8 |
| 2,633,252 | A | * | 3/1953 | Friedman | 206/453 |
| 2,980,477 | A | * | 4/1961 | Hansen | 108/27 |
| 3,762,626 | A | * | 10/1973 | Dorsey | 206/586 |
| 4,153,230 | A | * | 5/1979 | Giacin | 248/345.1 |
| 4,240,225 | A | * | 12/1980 | Sartain | 49/462 |
| 4,320,614 | A | * | 3/1982 | Brezosky | 52/630 |
| 4,370,373 | A | * | 1/1983 | Janicz | 428/151 |
| 4,558,553 | A | * | 12/1985 | Kolk | 108/27 |
| 4,731,918 | A | * | 3/1988 | Burghardt | 29/525.12 |
| 4,810,550 | A | * | 3/1989 | Gasser | 428/100 |
| 5,688,569 | A | * | 11/1997 | Gilmore et al. | 428/31 |
| 6,219,980 | B1 | * | 4/2001 | Peck, Jr. | 52/288.1 |
| 6,261,653 | B1 | * | 7/2001 | Smith | 428/35.7 |

* cited by examiner

*Primary Examiner* — Terrell McKinnon
*Assistant Examiner* — Monica Millner
(74) *Attorney, Agent, or Firm* — Knobbe, Martens, Olson & Bear, LLP

(57) ABSTRACT

A corner protector can be mated with an article of furniture having a corresponding notch. The corner protector can include a body having an upper surface, a lower surface, a first side, a second side, and a blunted corner. Generally, in the mated configuration the blunted corner is oriented outwardly, thus providing a rounded surface that can reduce injury in the event of an impact with the article of furniture.

28 Claims, 13 Drawing Sheets

CORNER PROTECTOR

CROSS-REFERENCE TO RELATED APPLICATIONS

This application claims the benefit of Chinese Patent Application No. 201020201619.6, filed on May 11, 2010, the entirety of which is incorporated herein by reference in its entirety.

BACKGROUND

1. Field

This disclosure relates to furniture accessories, and in particular to devices and methods that provide a blunted surface on a corner of an article of furniture thereby reducing the likelihood of injury associated with impacting the corner.

2. Description of the Related Art

Articles of furniture, such as tables, desks, chairs, benches, couches, beds, shelves, and the like, are well known. Articles of furniture often have a rectangular shape, which can facilitate manufacturing of the article given that forming straight shapes can typically be done more easily and cost-effectively than forming curved shapes. To reduce cost, articles of furniture are frequently formed of a composite material, such as particle board or fiber board.

While furniture having a rectangular shape can facilitate manufacturing, such articles normally also have relatively sharp corners. For example, tables with a rectangular top portion often have corners formed at about a 90° angle. Such corners can pose a serious safety hazard should a person impact the corner, such as during a fall. The safety risk can be exacerbated in areas visited by populations having sub-optimal dexterity, e.g., children, elderly persons, persons with illness, etc. Likewise, areas of increased bodily activity, such as gymnasiums and classrooms, can also be areas in which the risk of a person impacting the corner of an article of furniture is increased.

One solution would be to adhere cushioning to the corners, but such cushions can be fairly easily removed (intentionally or accidentally) and often have an effectiveness that is limited by a desire for the cushion to have a narrow thickness, so as not to extend too far beyond the surface of the furniture. Another solution would be to sand or grind the corners of the article of furniture into a rounded shape, but such processes can add additional steps and increase manufacturing cost and time. Indeed, for articles of furniture manufactured with composite materials, such sanding or grinding processes may not be feasible because the composite material would simply splinter.

SUMMARY

Accordingly, it can be advantageous to provide a corner protection device for an article of furniture, wherein the device can reduce the likelihood of injury, can inhibit removal of the device, and does not inhibit the economic manufacture of the article of furniture.

In some embodiments, a corner protector for a corner of an article of furniture, comprises: a body configured to mate in a notch in the article of furniture, the body having an upper surface, a first side, and a second side, wherein the upper surface intersects the first side and the second side in a proximal portion of the corner protector, and the first side intersects the second side; a projection extending from the body along a longitudinal axis and configured to mate in a void in the article of furniture; an extension portion extending from the upper surface generally away from the proximal portion, the extension portion configured to overlap a surface of the article of furniture; and a rounded corner configured to reduce injuries associated with impacting the article of furniture, the rounded corner disposed at the intersection of the upper surface, the first side, and the second side.

In some embodiments, the first side and the second side are substantially orthogonal to each other and to the upper surface and the lower surface. In some embodiments, the body further comprises a lower surface, the upper surface and the lower surface being substantially parallel. The lower surface can also include a periphery having a radiused portion. In some embodiments, the projection further comprises an opening configured to receive a fastener.

In some embodiments, the projection is substantially hollow and/or cylindrical. In some embodiments, the body further comprises one or more struts disposed in the cavity and configured to provide rigidity to the body. In some embodiments, the corner protector is a thermoplastic. In some embodiments, the extension portion contacts the surface of the article of furniture.

In some embodiments, a method of manufacturing a corner protector for an article of comprises: forming a body configured to mate in a notch in the article of furniture, the body having an upper surface, a first side, and a second side, wherein the upper surface intersects the first side and the second side in a proximal portion of the corner protector, and the first side intersects the second side; forming a projection extending from the body along a longitudinal axis and configured to mate in a void in the article of furniture; forming an extension portion extending from the upper surface generally away from the proximal portion, the extension portion configured to overlap a surface of the article of furniture; and forming a rounded corner configured to reduce injuries associated with impacting the article of furniture, the rounded corner disposed at the intersection of the upper surface, the first side, and the second side. In some embodiments, an injection molding process forms one or more of the body, projection, and extension.

In some embodiments, a method of manufacturing an article of furniture, comprises: obtaining the components of an article of furniture, at least one of the components having at least one corner; forming a notch in the at least one corner; positioning a protector in the notch, the protector comprising a rounded face configured to reduce injuries associated with impacting the article of furniture; and packaging the components for shipment.

In some embodiments, forming the notch comprises routing the corner with a router. In some embodiments forming the notch comprises cutting the corner with a saw. Some embodiments further comprise forming a void in the component of the article of furniture. Some embodiments also comprise positioning a projection of the protector in the void in the component of the article of furniture. Additionally, some embodiments comprise securing the projection to the component with a fastener.

Some embodiments further comprise positioning an extension portion of the protector overhanging a portion of a surface of the component of the article of furniture. Some embodiments further comprise assembling the components to form the article of furniture.

DETAILED DESCRIPTION

A variety of corner protectors are described below to illustrate various examples that may be employed to achieve the desired improvements. These examples are only illustrative and not intended in any way to restrict the embodiments of the general invention presented and the various aspects and features of these embodiments. Furthermore, the phraseology and terminology used herein is for the purpose of description and should not be regarded as limiting. No features, structure, or step disclosed herein is essential or indispensable.

Figure 1:
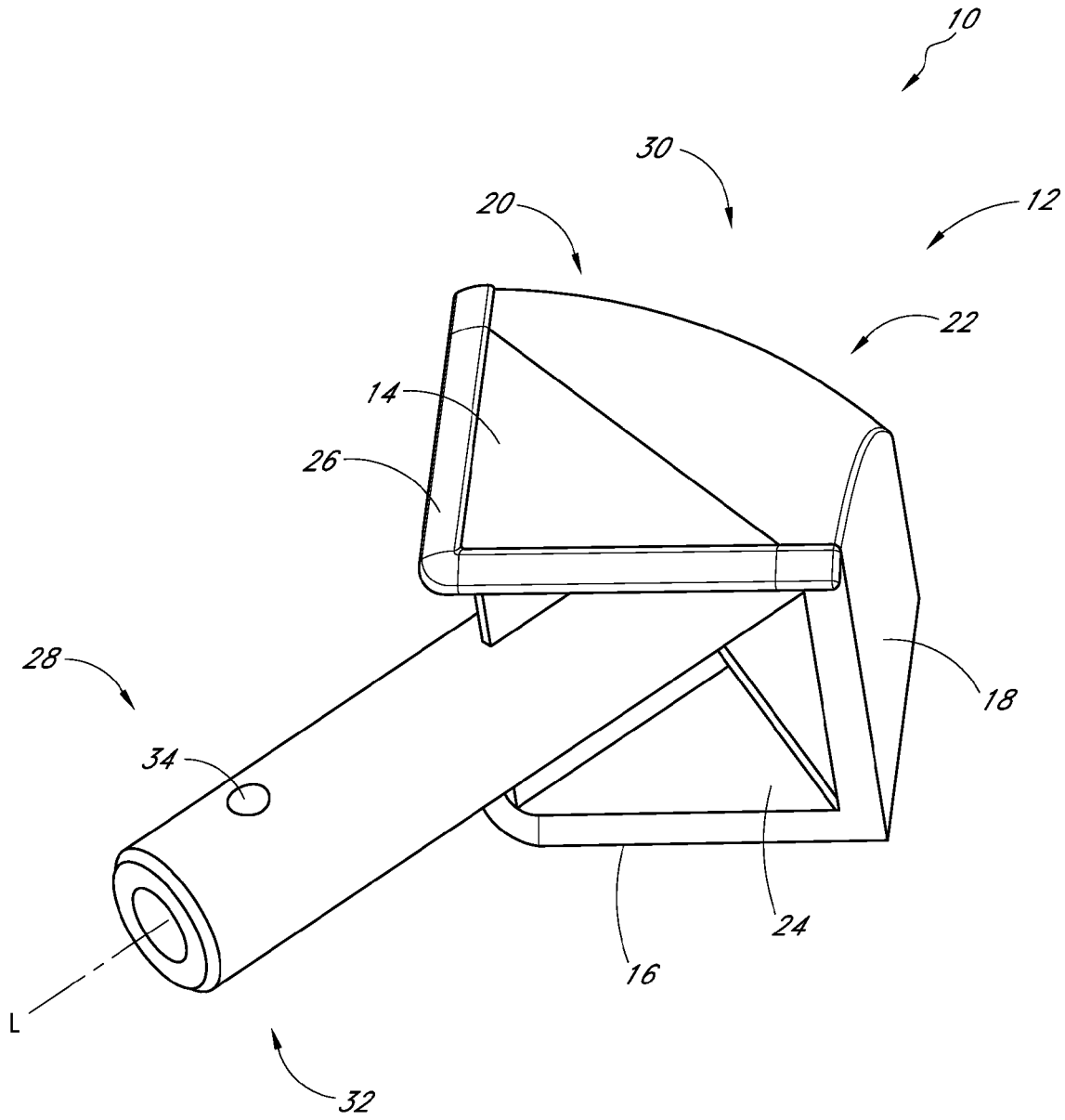
FIG. 1. illustrates a perspective view of an embodiment of a corner protector.
Figure 2:
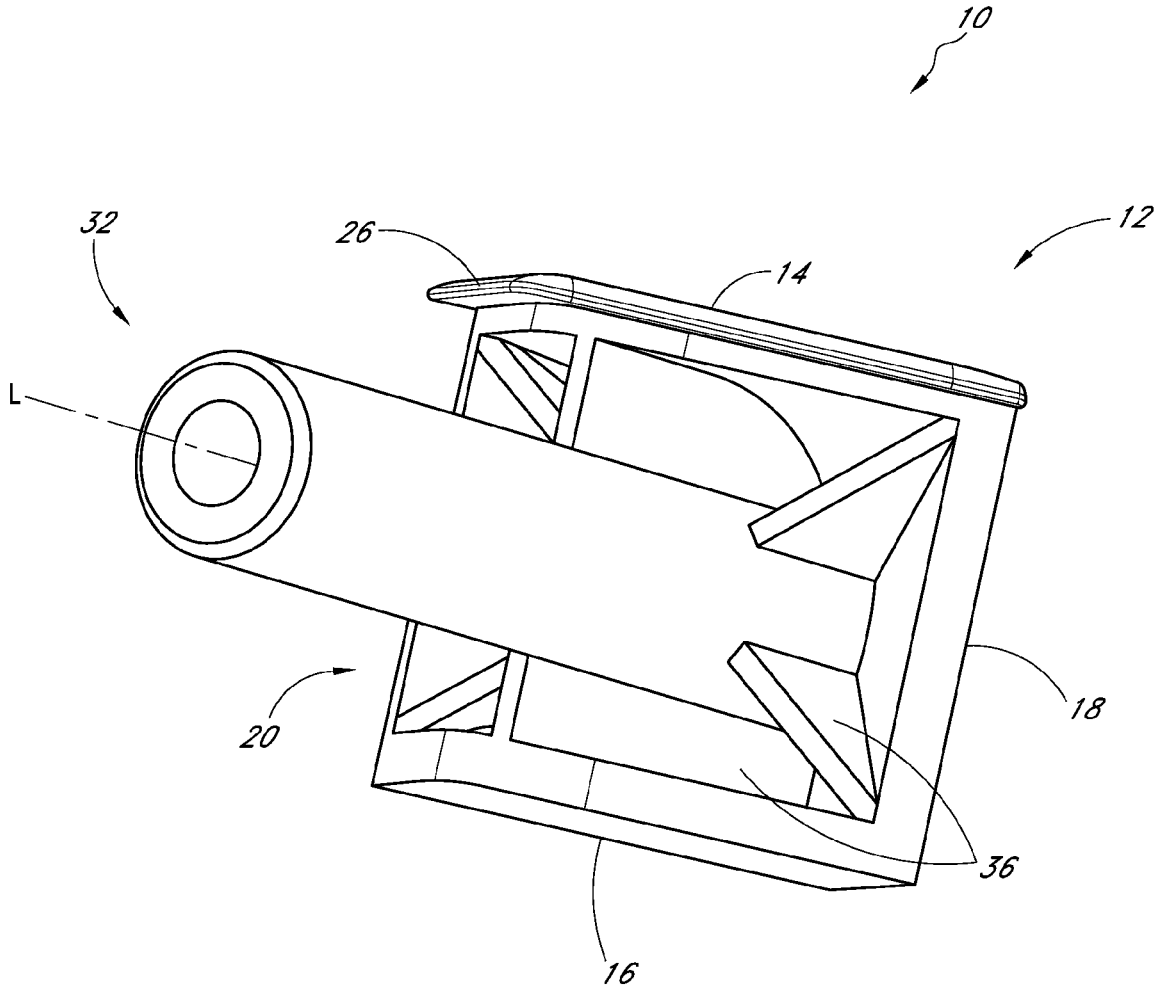
FIG. 2. illustrates a perspective view of the corner protector of FIG. 1.
Figure 3A:
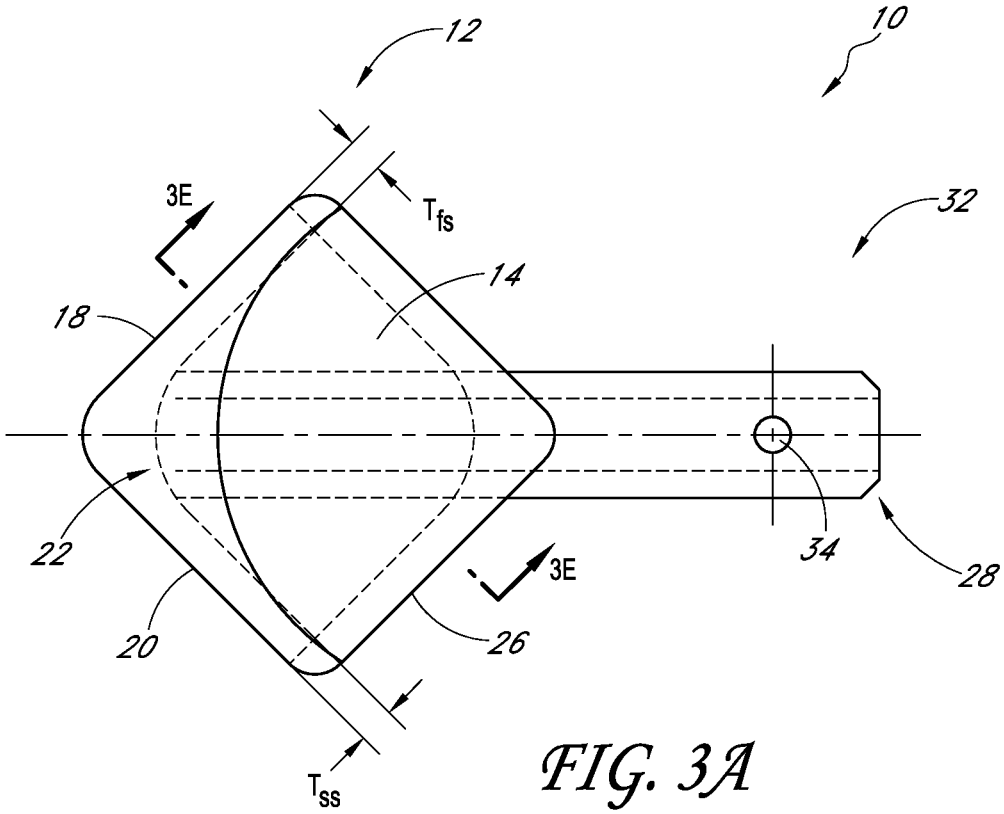
FIG. 3A illustrates a top view of the corner protector of FIG. 1.
Figure 3B:
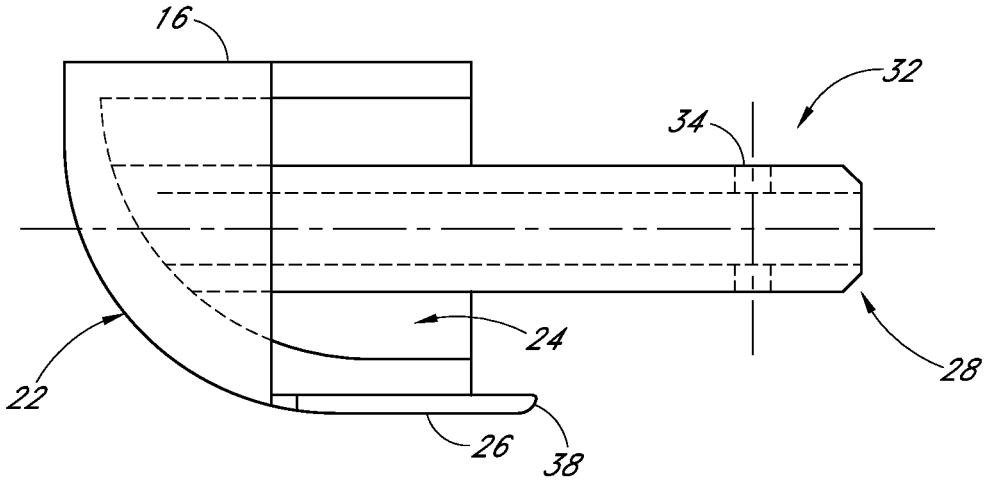
FIG. 3B illustrates a side view of the corner protector of FIG. 1.
Figure 3C:
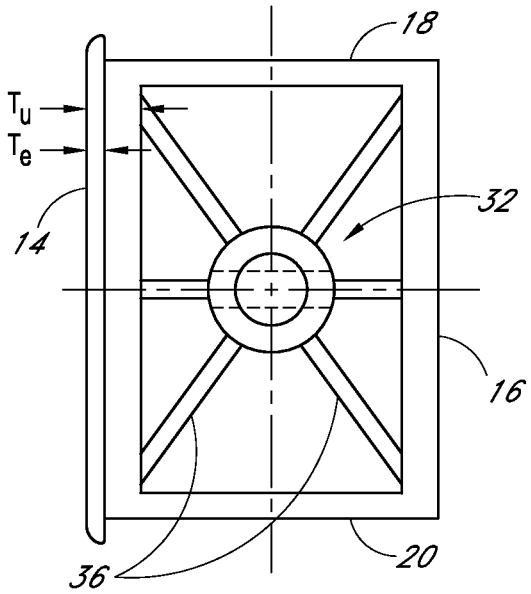
FIG. 3C illustrates a back view of the corner protector of FIG. 1.
Figure 3D:
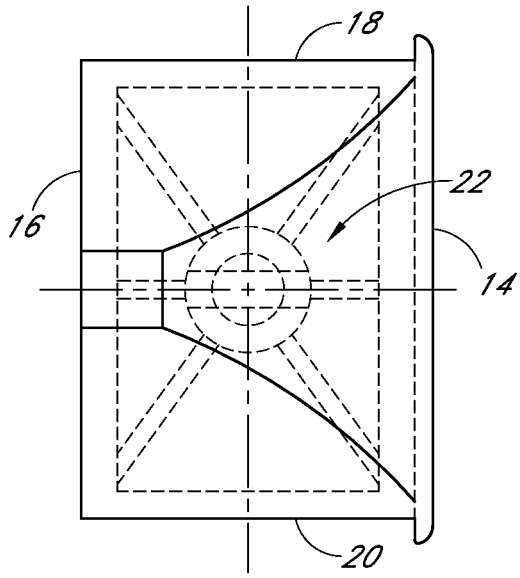
FIG. 3D illustrates a front view of the corner protector of FIG. 1.
Figure 3E:
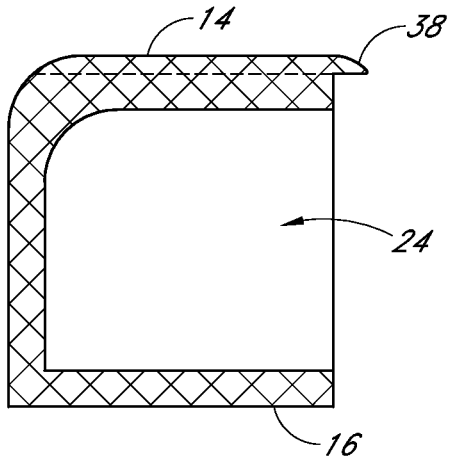
FIG. 3E illustrates a cross-sectional view of the corner protector of FIG. 3A.

As shown in the non-limiting embodiments of FIGS. 1 and 2, a corner protector 10 can include a body 12 having an upper surface 14, a lower surface 16, a first side 18, and a second side 20. In various embodiments, portions of the body 12 intersect. For example, the upper surface 14 can intersect the first side 18 and the second side 20; the lower surface 16 can intersect the first side 18 and the second side 20; and/or the first side 18 can intersect the second side 20. The body 12 can have a shape (from a top view) that is generally rectangular, square, circular or portions thereof (e.g., ¼), and the like. Of course, many other shapes are contemplated, such as generally triangular, as discussed in further detail below.

Often, the upper surface 14, the first side 18, the second side 20 intersect at a rounded corner 22, which can reduce injury by providing a rounded surface, rather than a sharp corner. Various radii of the rounded corner 22 are contemplated, such as at least about 0.1 mm and/or less than or equal to about 20.0 mm. In some embodiments, the radius of curvature of the corner is non-uniform, such that the radius changes along the intersection of one or more portions of the body 12. For example, in some embodiments at the intersection of the upper surface 14, the first side 18, the second side 20, the radius of curvature is a first radius; along the intersection of the upper surface 14 and the first side 18 and/or the upper surface and the second side the radius of curvature is a second radius. In some embodiments, the first radius may be greater than the second radius.

The body 12 can generally form a cavity 24. In the illustrated embodiment, the cavity 24 is an open hollow space formed by the upper surface 14, lower surface 16, first side 18, and second side 20. The cavity can be hollow, which can reduce the overall weight of and the amount of material used to form the corner protector 10. In some embodiments, the cavity is a closed space that is not open to the ambient environment.

With reference to the non-limiting embodiments illustrated in FIGS. 3A-3E, an extension portion 26 can extend from the body 12. The extension portion 26 shown extends from the upper surface 14, however other locations for the extension portion 26 are contemplated. For example, the extension portion 26 could extend from the lower surface 16, the first side 18, and/or the second side 20 rather than—or in addition to—extending from the upper surface 14. Typically, the extension portion 26 extends away from the body 12. For instance, in some embodiments at least some of the extension portion 26 extends away from a proximal end 30 of the corner protector 10 and toward a distal end 28 thereof. In some embodiments, at least some of the extension portion 26 extends substantially parallel with the first side 18 and/or second side 20.

Generally, the extension portion 26 has a thickness $T_e$ that is less than a thickness of the portion of the body 12 from which the extension portion 26 extends. For instance, in embodiments in which the extension portion 26 extends from upper portion 14, the thickness $T_e$ of the extension portion 26 is normally less than a thickness $T_u$ of the upper portion 14. Likewise, in embodiments in which the extension portion 26 extends from the first side 18 and/or second side 20, the thickness $T_e$ of the extension portion 26 is normally less than a thickness $T_{fs}$ of the first side 18 and/or a thickness $T_{ss}$ of the second side 20. In some embodiments, the thickness $T_u$ of the upper portion 14, a thickness $T_l$ of the lower portion 16, the thickness $T_{fs}$ of the first side 18, and/or the thickness $T_{ss}$ of the second side 20 is at least about 0.5 mm and/or less than or equal to about 5.0 mm. The thickness $T_e$ of the extension portion 26 is typically at least about 10% and/or less than or equal to about 60% of the thickness of the portion of the body 12 from which the extension portion extends. Furthermore, in some embodiments, the extension portion 26 is wider than the body 12. Also, some aspects of the extension portion 26 have a distal extension portion 38 that is radiused or chamfered, which can assist in providing a smoothed surface transition, discussed below.

A projection 32 can extend from the body 12 along a longitudinal axis L. In some embodiments, the projection 32 extends toward the distal end 28 of the corner protector 10. In some embodiments, the projection 32 extends away from the rounded corner 22. In the non-limiting embodiment shown, the projection 32 is an elongate cylindrical member, though many other elongate shapes are contemplated, such as conical, frustoconical, rectangular, and the like. Further, the projection 32 can have many different axial cross-sectional shapes, such as, circular, oval, rectangular, star-shaped, polygonal, irregular, and the like. In some embodiments, the projection 32 is at least partially hollow, which can facilitate manufacture of the corner protector 10, decrease the volume of material used to form the corner protector 10, and/or reduce the overall weight of the corner protector 10. Furthermore, in some embodiments, the distal end 28 is radiused or chamfered to facilitate installation of the corner protector 10 with an article of furniture, as discussed in further detail below. The projection 32 illustrated is substantially smooth, however, in other embodiments the projection 32 includes ribs 44 (not shown) similar to those described below.

In some embodiments, the projection 32 includes an opening 34, which can receive an adhesive (e.g., glue, epoxy, and the like) and/or a fastener (e.g., nail, screw, bolt, rivet, peg, and the like). The opening 32 typically extends substantially perpendicular to the axis L. In some aspects, the opening is a through-hole that extends through the protector 32. The opening 34 can have a variety of shapes and sizes and can be threaded or non-threaded.

Some embodiments of the corner protector 10 can have one or more struts 36 in the body 12. The struts 36 can provide rigidity and/or structural integrity to the corner protector 10 and portions thereof, such as the body 12 and the projection 32. As shown in the non-limiting embodiment of FIG. 3C, the struts can be arranged substantially symmetrically around the projection 32. Other embodiments are contemplated, such as an arrangement in which the struts 36 are irregularly disposed around the projection 32. In some embodiments, the struts 36 do not contact the projection 32. Generally, the struts are substantially contained within the cavity 24. In some embodiments, one or more of the struts 36 extend farther toward the distal end 28 than another one or more of the struts 36.

Figure 4:
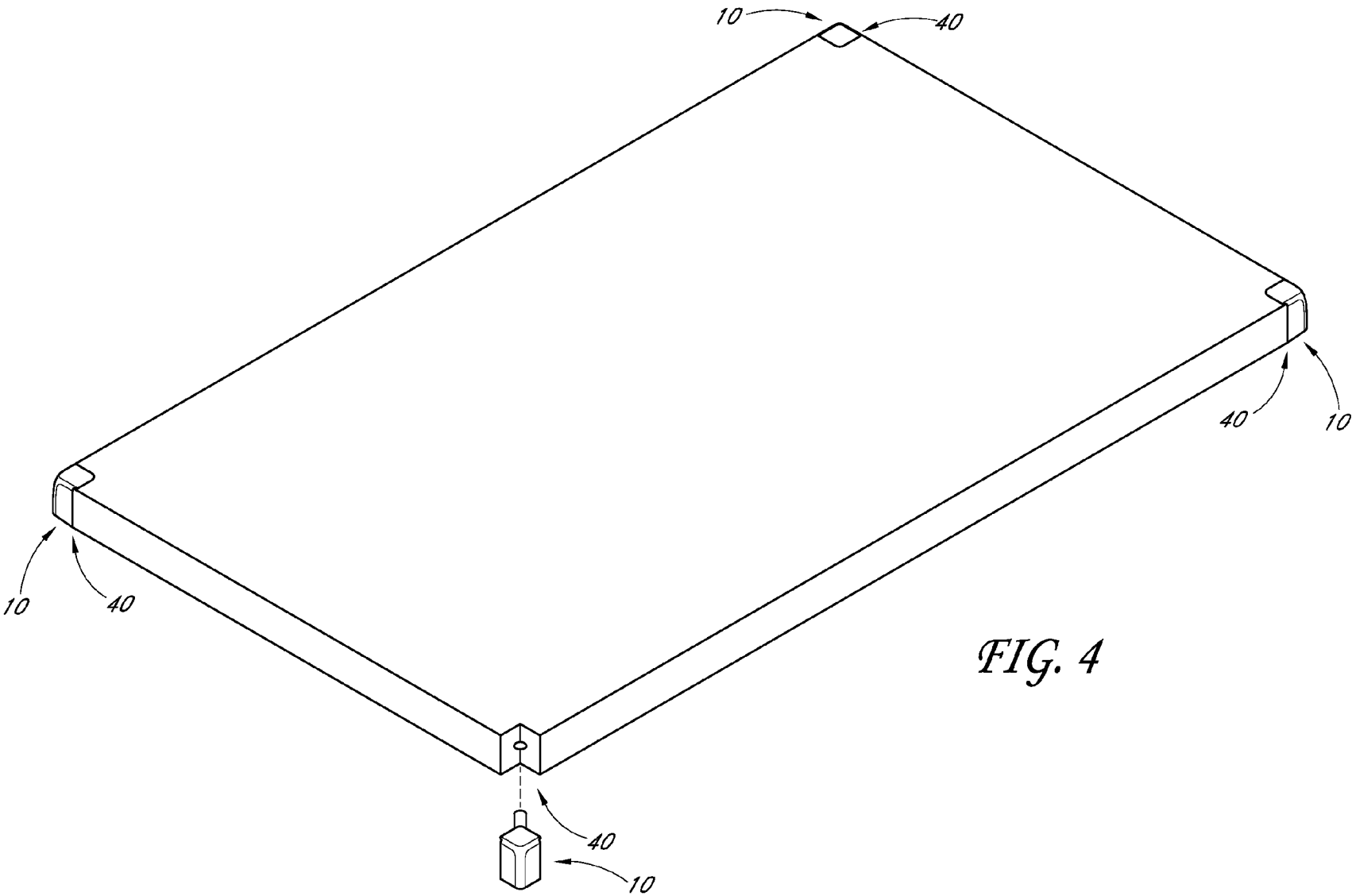
FIG. 4 illustrates a perspective view of the corner protector of FIG. 1 and a portion of an article of furniture having an exemplary notch.
Figure 5:
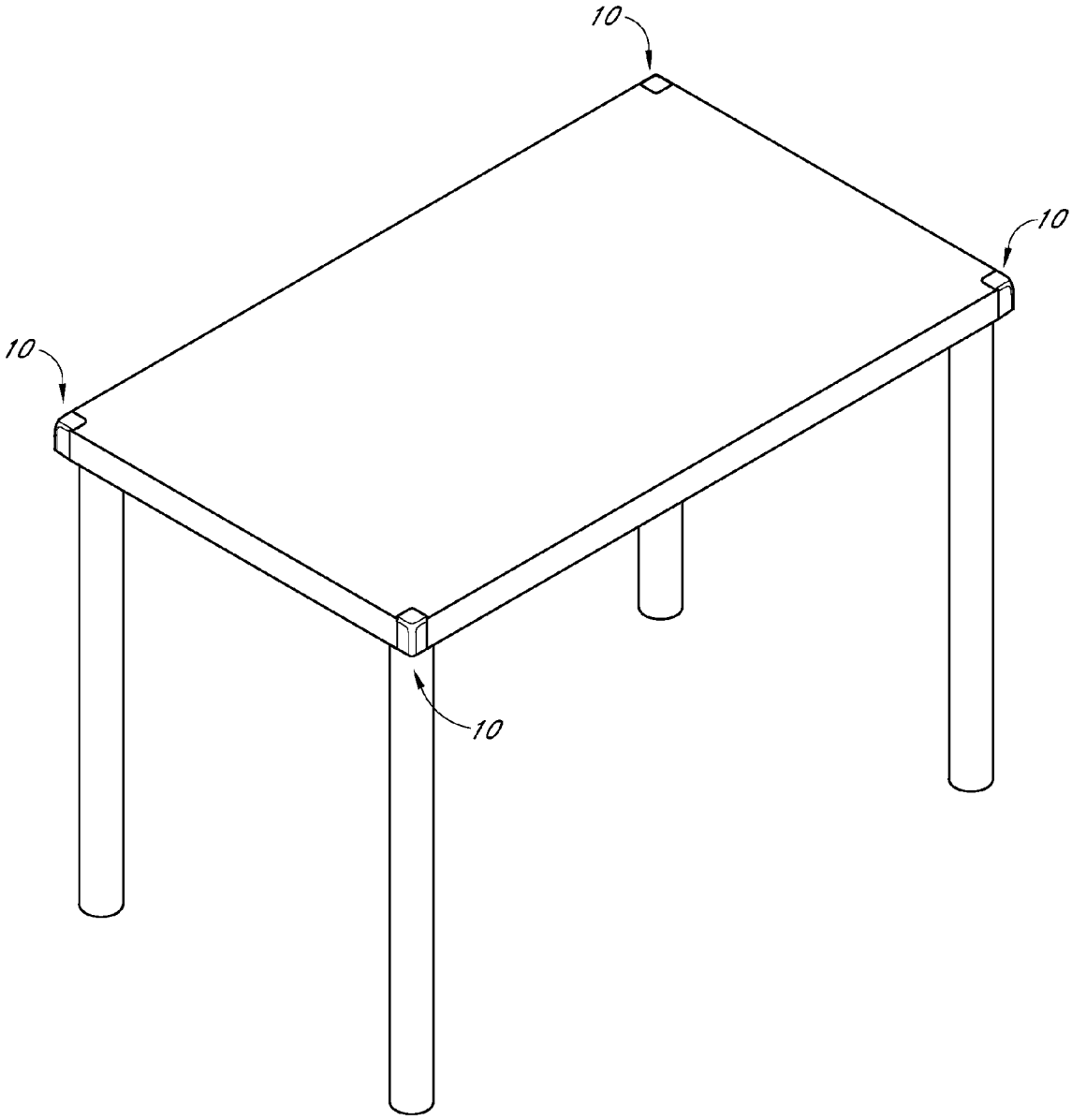
FIG. 5 illustrates a perspective view of the corner protector of FIG. 1 mated with an exemplary table.
Figure 6:
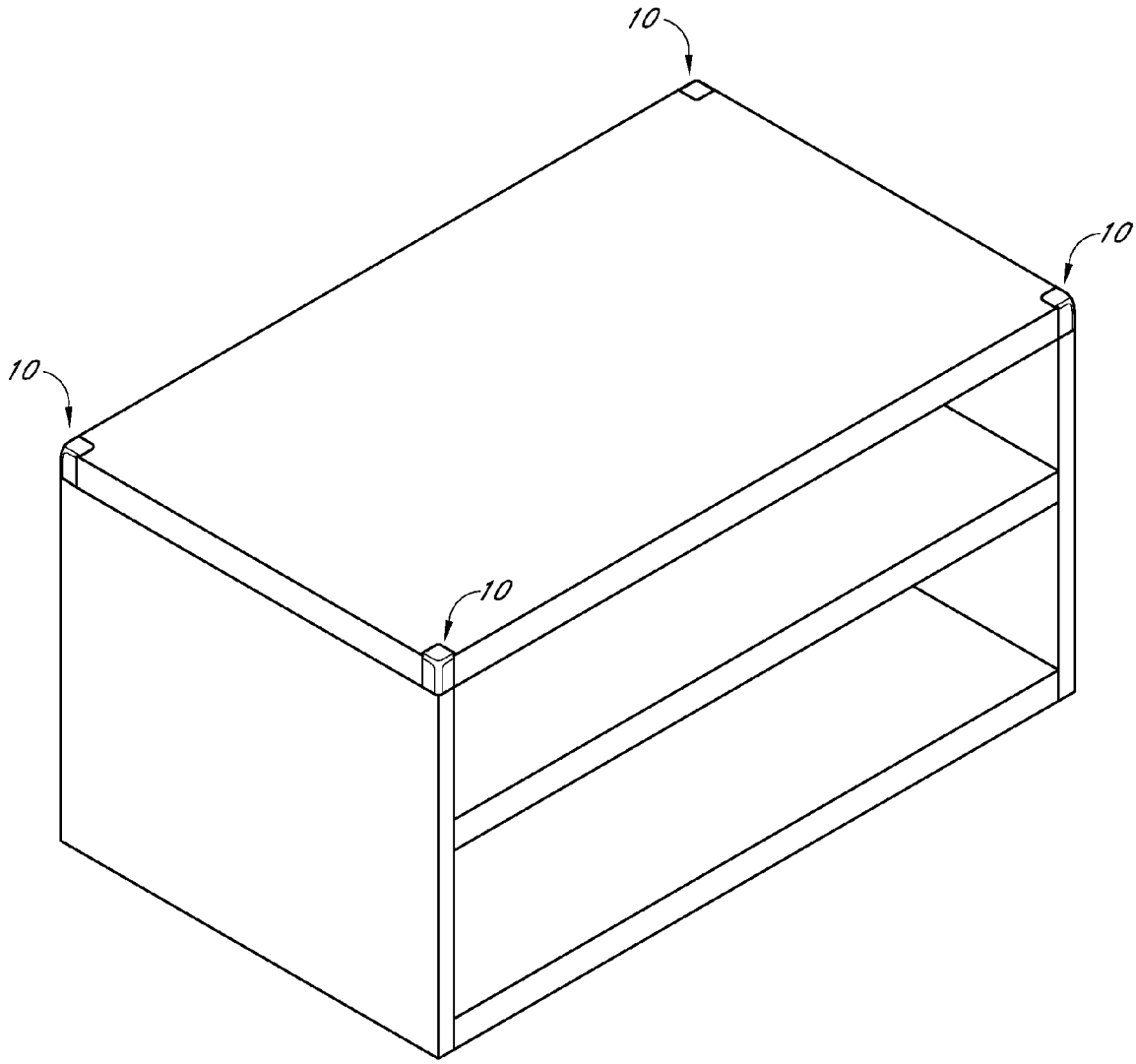
FIG. 6 illustrates a perspective view of the corner protector of FIG. 1 mated with an exemplary shelving unit.
Figure 7:
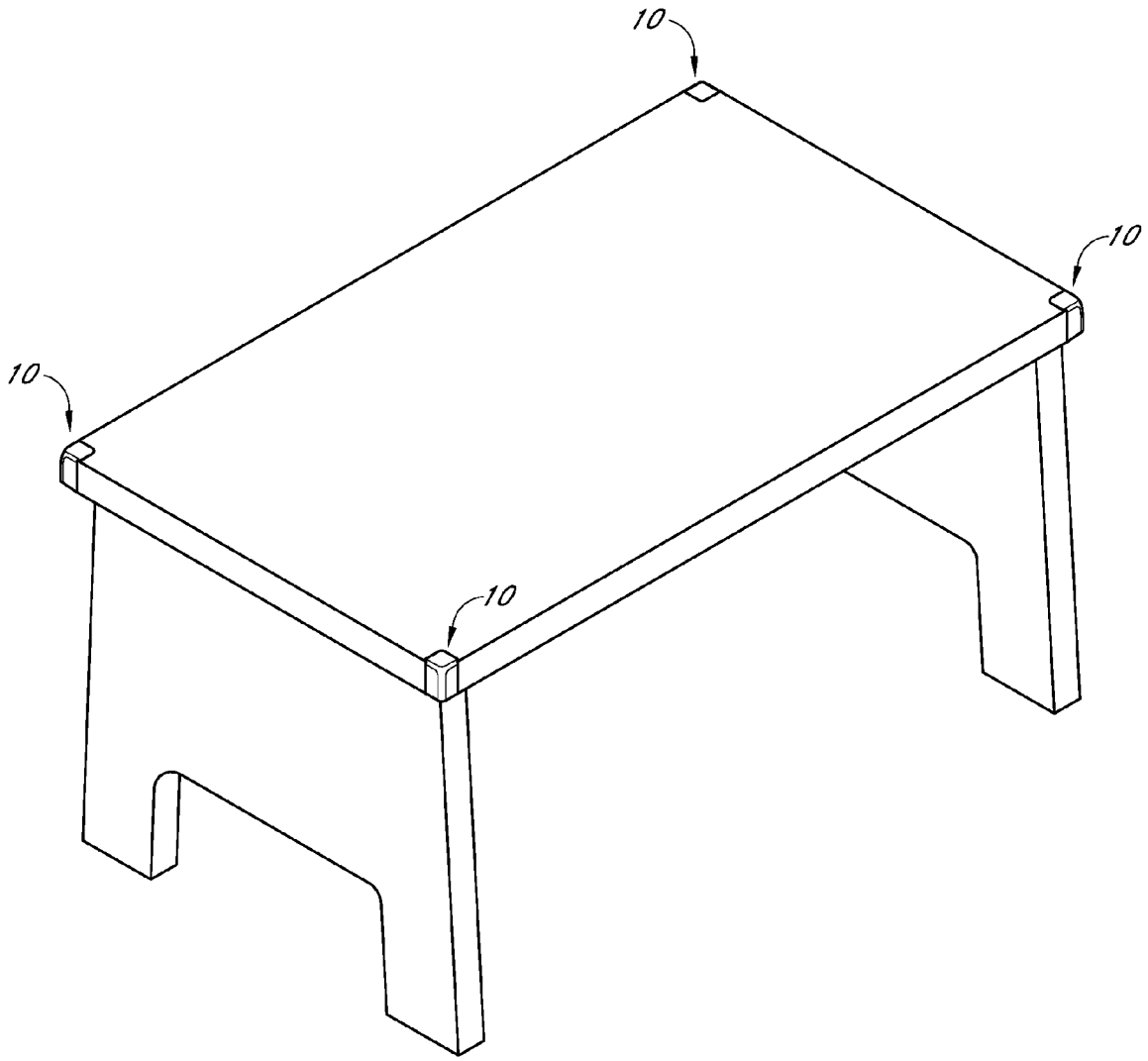
FIG. 7 illustrates a perspective view of the corner protector of FIG. 1 mated with an exemplary bench.
Figure 8A:
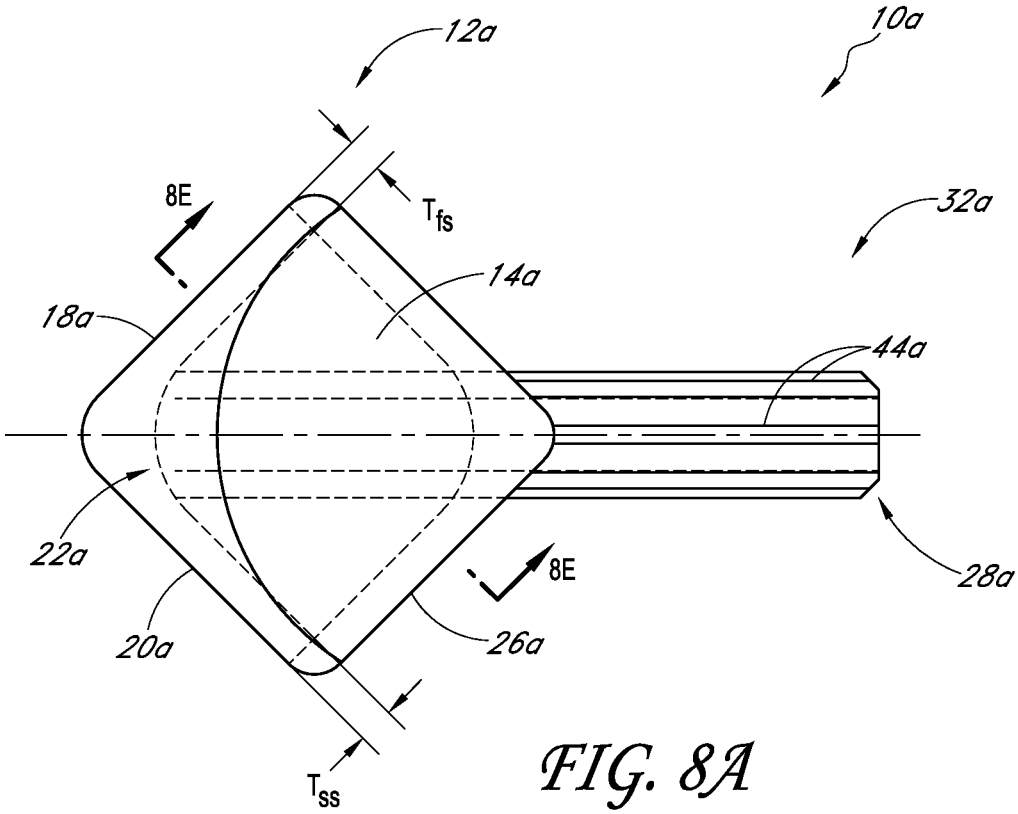
FIG. 8A illustrates a top view of an embodiment of a corner protector.
Figure 8B:
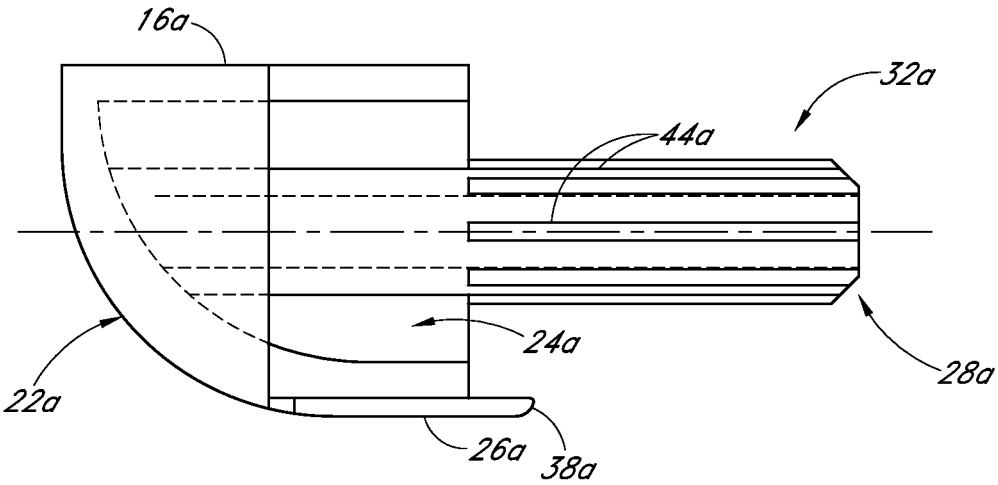
FIG. 8B illustrates a side view of the corner protector of FIG. 8A.
Figure 8C:
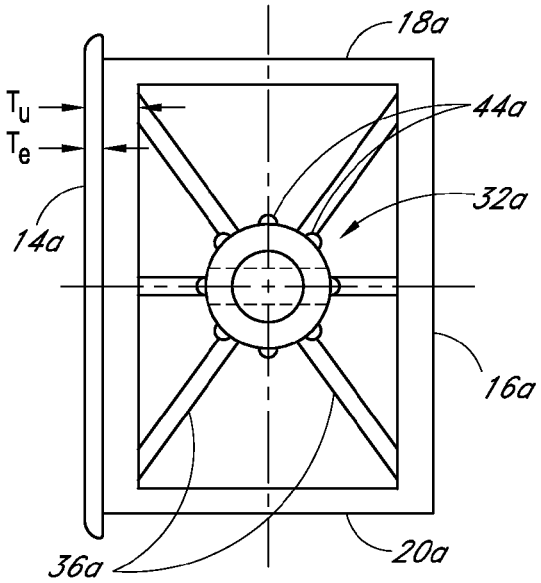
FIG. 8C illustrates a back view of the corner protector of FIG. 8A.
Figure 8D:
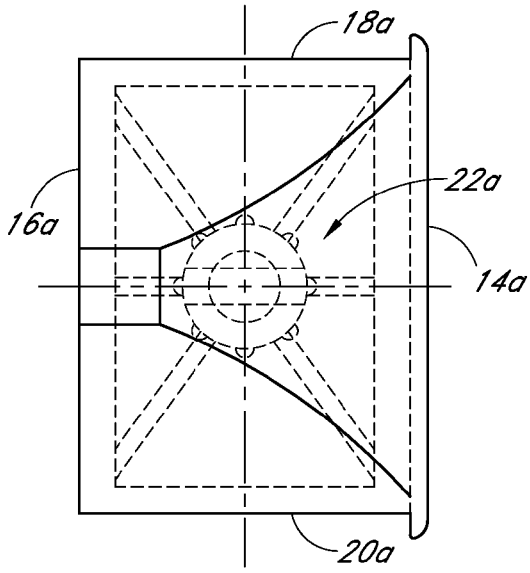
FIG. 8D illustrates a front view of the corner protector of FIG. 8A.
Figure 8E:
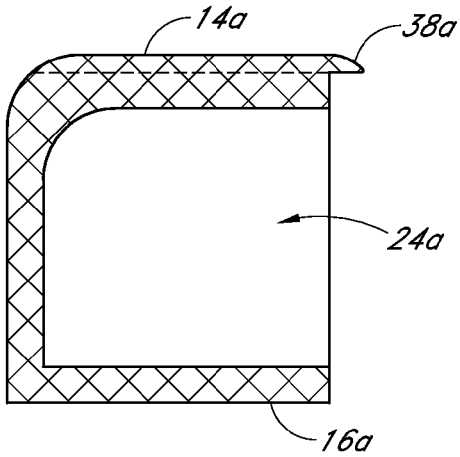
FIG. 8E illustrates a cross-sectional view of the corner protector of FIG. 8A.
Figure 9A:
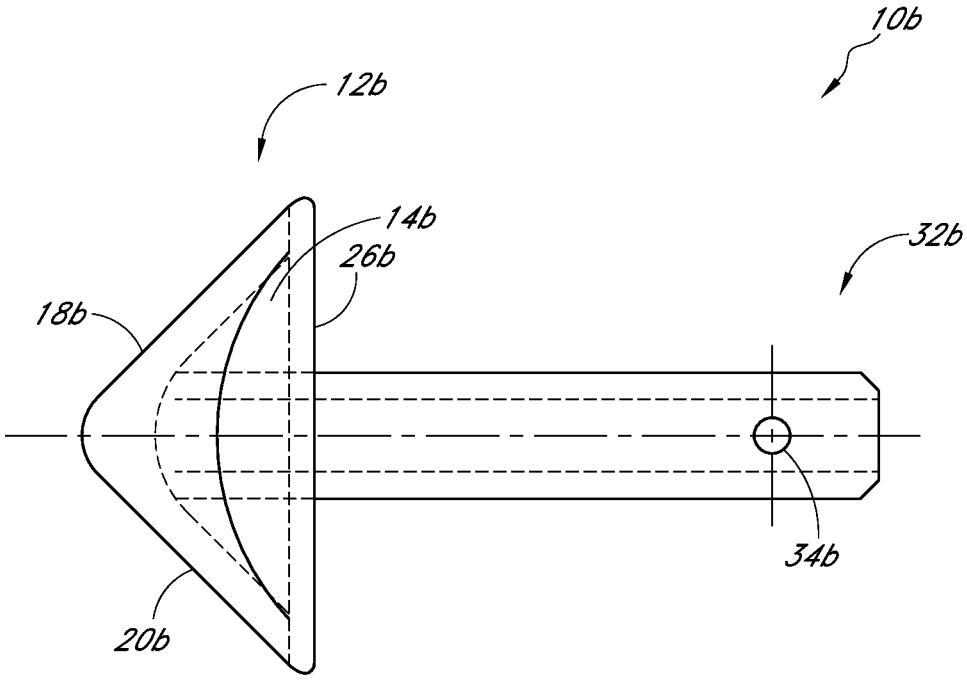
FIG. 9A illustrates a top view of an embodiment of a corner protector.
Figure 9B:
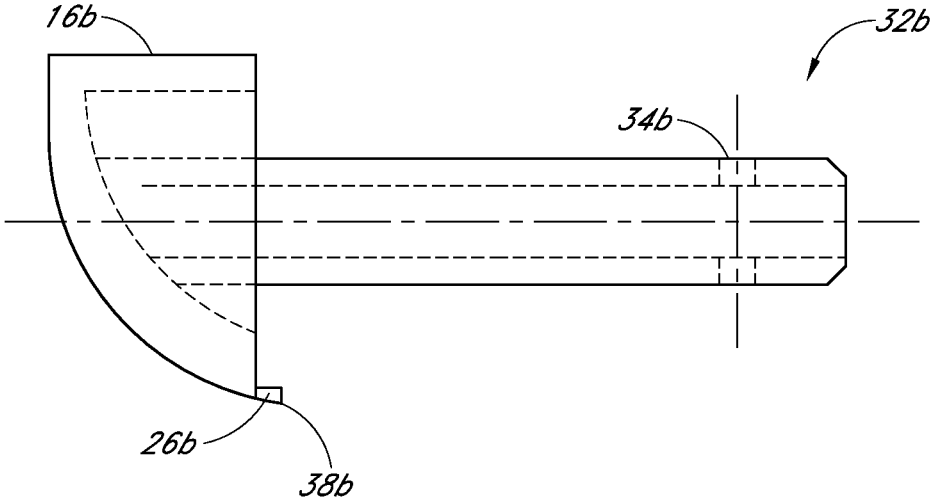
FIG. 9B illustrates a side view of the corner protector of FIG. 9A.
Figure 9C:
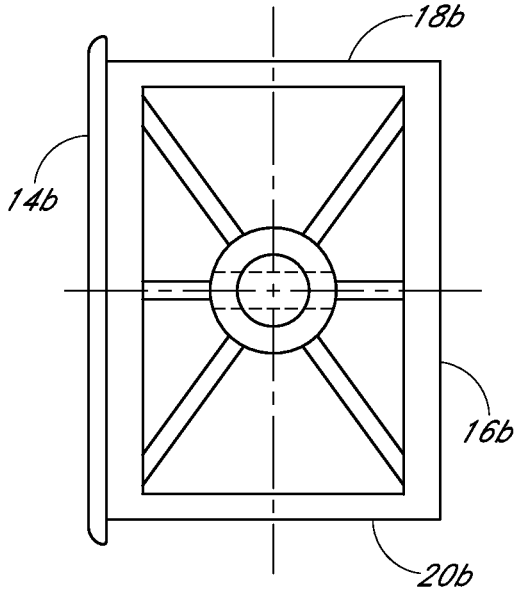
FIG. 9C illustrates a back view of the corner protector of FIG. 9A.
Figure 9D:
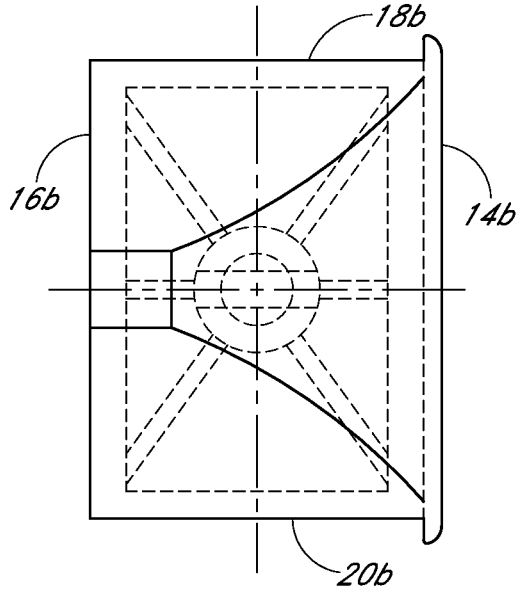
FIG. 9D illustrates a front view of the corner protector of FIG. 9A.
Figure 9E:
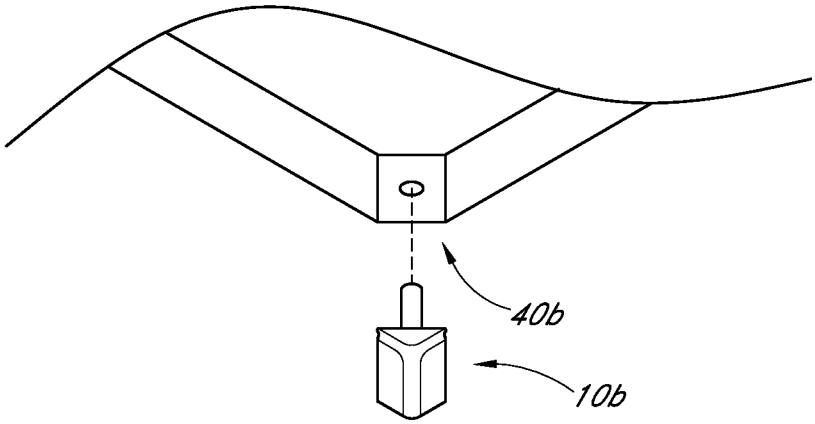
FIG. 9E illustrates a partial perspective view of the corner protector of FIG. 9A and a portion of an article of furniture having a notch.

Generally, the body 12 of the corner protector 10 is configured to mate with a notch 40 in a corner of an article of furniture, such as a table, desk, chair, shelving unit, bench, or the like. See, for example, FIG. 4. For articles of furniture having multiple corners, notches 40 can be formed at each of the corners and one of the corner protectors 10 can be mated with each of the notches 40. For example, as shown in FIGS. 5-7, a table, a shelving unit, and a bench can each include four corners, four notches 40 (not shown), and four corner protectors 10. Multiple corner protectors 10 can provide injury protection from multiple directions of approach to the article of furniture, e.g., the front, sides, and back of the article of furniture.

Typically, the body 12 is configured to be closely received in the notch 40. For example, if the notch 40 is substantially cubic in shape, then the body 12 typically has a substantially similar size and shape. Of course, the body 12 can also include deviations from the size shape of the notch 40 (such as the body 12 having the rounded corner 22). Typically, the body 12 is configured such that, when the body 12 is mated with the article of furniture, the upper surface 14, lower surface 16, first side 18, and second side 20 are each about flush with corresponding surfaces of the article of furniture. For example, the body 12 is often configured such that when the body 12 is mated with the notch 40, the first and second sides 18, 20 are about flush with side surfaces of the article of furniture. In some embodiments, when the corner protector 10 is mated with the notch 40 in the article of furniture, the rounded corner 22 is oriented outwardly—away from the article of furniture. Thus, in the mated configuration, the corner protector 10 provides a rounded surface, rather than a sharp angle, at the corner of the article of furniture.

In some embodiments, the corner protector 10 is secured and stabilized by the projection 32 being received in an elongate void in the article of furniture. A fastener can be disposed through the furniture, through the void, and into the opening 34, thereby providing a fastening connection between the article of furniture and the corner protector 10. Such a connection can secure the corner protector 10 to the article of furniture and inhibit removal—accidental or intentional—of the corner protector 10. For instance, in some embodiments, the corner protector 10 is configured to be received into a notch 40 in the corner of a classroom tabletop, the projection 32 is configured to be received in a hole in the tabletop, and a screw is screwed through the tabletop, into the hole, and into the opening 34 thereby firmly retaining the corner protector 10 in the tabletop.

In embodiments of the corner protector 10 having an extension portion 26, often the extension portion 26 is configured to extend toward the distal end 28. For example, the extension portion 26 can extend at least about 0.25 mm and/or less than or equal to about 25.4 mm. When the corner protector 10 is mated with the article of furniture, the extension portion 26 typically extends over the intersection of the body 12 with the notch 40 in the furniture. As such, the extension portion can provide a smoothed surface transition from the furniture to the corner protector 10, which can enhance visual beauty by making the corner protector 10 appear seamlessly formed with the article of furniture. Indeed, such a smooth transition can be further aided in embodiments with extension portions 26 having a radiused or chamfered distal extension portion 38.

The extension portion 26 can also be configured to contact a surface of the furniture when the corner protector 10 is mated with the article of furniture. For instance, in embodiments having an extension portion 26 extending from the upper surface 14, the extension portion 26 can overlap a top surface (e.g., a table top or the top of a shelf unit) of the furniture. In some embodiments, the extension portion contacts the top surface of the furniture. Similarly, in embodiments having an extension portion 26 extending from the first and/or second sides 18, 20, the extension portion 26 can overlap and/or contact side surfaces of the furniture, which can provide support for the extension portion 26. In some embodiments, contact between the extension portion 26 and one or more surfaces of the furniture provides a seal, which can deter contaminants (e.g., spilled liquids) from reaching the notch 40 and inhibit potential damage to the furniture (e.g., rot).

The corner protector 10 can also provide installation benefits. Unlike operations that round the corner of the article of furniture directly, such as grinding or sanding, installation of the corner protector 10 is quick, produces little dust, and does not require power tools. Indeed, sanding or grinding may not be viable options for articles of furniture made from some composite materials as the material would simply splinter. On the other hand, cutting the notch 40 for the corner protector 10 typically does not pose such drawbacks. Further, in embodiments of the corner protector 10 in which a fastener is not used, the corner protector 10 can be installed without even the need for hand tools, e.g., hammer, screwdriver, and the like.

Some embodiments of the corner protector 10 have features to facilitate manufacturing of the notch 40 in the article of furniture. For instance, the lower surface 16 can include a rounded corner that can mate with a corresponding rounded feature in the notch 40. In some embodiments, such a rounded (rather than a right-angle) feature in the notch 40 can aid in producing the notch 40, e.g., with a router. See, for example, FIGS. 2 and 3A.

The corner protector 10 can be made from plastic, silicone, rubber, wood, metal (e.g., steel, aluminum, titanium, and the like), or a composite material. In some embodiments, the corner protector 10 is made of a thermoplastic. In some embodiments, the corner protector 10 is colored or textured, e.g., wood grain, to blend with the article of furniture.

The corner protector 10, and components thereof, can be formed using many manufacturing processes sufficient to provide the desired shape of the components. In some embodiments, one or more components are made by a molding process, such as insert molding, injection molding, compression molding, blow molding, rotational molding, transfer molding, thermoforming, or similar. In some embodiments, one or more components are formed by forging, machining, casting, stamping, extrusion, a combination thereof, and the like. Different components can be formed using different materials and/or processes, such as the body 12 being a thermoformed plastic and the projection 32 being an extruded metal. However, the corner protector 10 is generally monolithic formed. Often, the corner protector 10 is configured and manufactured to facilitate mass production and/or low manufacturing costs.

FIGS. 8A-8E illustrate another embodiment of a corner protector 10*a*. Several features and components of the corner protector 10*a* are similar in form and function to those described above with respect to the corner protector 10, and have been provided with like numerals with the addition of "a" (e.g., 10*a*). To the extent components of the corner protector 10*a* differ slightly from those of the corner protector 10 described above, some of those differences are described and explained below. Any features and/or components of the disclosed embodiments can be combined or used interchangeably.

The corner protector 10*a* can include a projection 32*a* and a body 12*a* having an upper surface 14*a*, a lower surface 16*a*, a first side 18*a*, and a second side 20*a*. As shown, the projection 32*a* can include one or more ribs 44*a*. In some embodiments, the ribs 44*a* extend along a portion of the projection 32*a*, at least partly around the projection 32*a*, or a combination thereof (e.g., a helix configuration along and around the projection 32*a*). In some embodiments, the projection 32 is threaded. In some embodiments, the projection 32*a* does not have an opening configured to receive a fastener.

FIGS. 9A-9E illustrate another embodiment of a corner protector 10*b*. Several features and components of the corner protector 10*b* are similar in form and function to those described above with respect to the corner protectors 10, 10*a* and have been provided with like numerals with the addition of "b" (e.g., 10*b*). To the extent components of the corner protector 10*b* differ slightly from those of the corner protectors 10, 10*a* described above, some of those differences are described and explained below. Any features and/or components of the disclosed embodiments can be combined or used interchangeably.

The corner protector 10*b* can include a body 12*b* having an upper surface 14*b*, a lower surface 16*b*, a first side 18*b*, and a second side 20*b*. In some embodiments, the body 12*b* has a shape (from a top view) that is generally triangular. Such a shape can facilitate manufacturing of the corner protector 10*b* by reducing the amount of material in the corner protector 10*b*. Further, such a shape can facilitate manufacturing the notch 40*b* in the article of furniture, since the notch 40*b* can be made with a single straight cut, rather than multiple cuts and/or by routing. For example, as shown FIG. 9E, the notch 40*b* can be a straight cut at an angle of at least about 30° and/or less than or equal to about 60°, where the angle is relative to a side of the component of the article of furniture. In some embodiments, the notch is cut at about a 45° angle.

As shown, corner protector 10*b* includes a projection 32*b* with an opening 34*b*. As discussed above, the opening 34*b* can receive an adhesive and/or a fastener and thereby secure the corner protector 10*b* with the article of furniture. However, in other embodiments, the corner protector 10*b* does not have an opening 34*b*. In some embodiments, the projection 32*b* is substantially smooth. In other embodiments, the projection 32*b* includes ribs 44*b* (not shown) similar to those described above.

Figure 10:
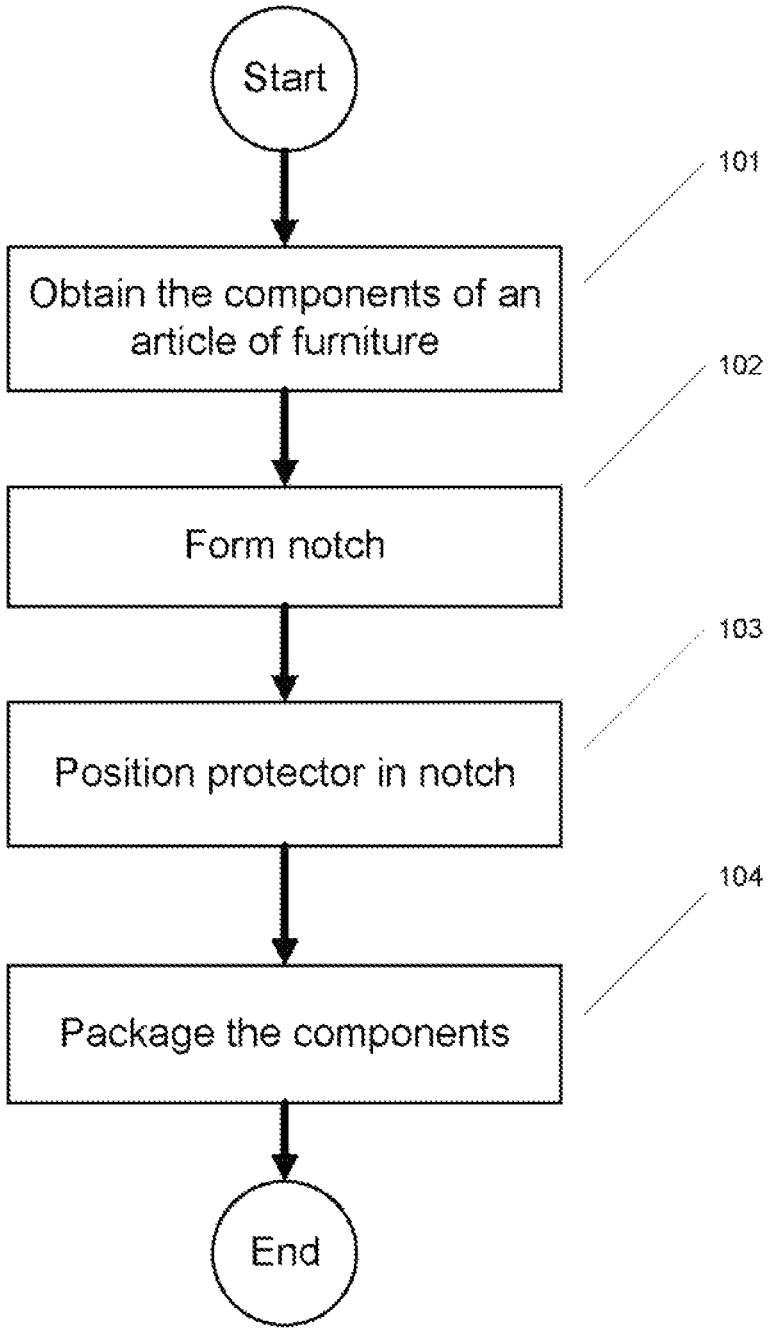
FIG. 10 schematically illustrates a method of manufacturing an article of furniture including a corner protector.

Turning to FIG. 10, an embodiment of a method of manufacturing an article of furniture is illustrated. In a first block 101, the components of an article of furniture are obtained. Generally, at least one of the components includes at least one corner. In a second block 102, a notch is formed in the at least one corner. In block 103, a protector can be positioned in the notch. In some embodiments, the protector comprises a rounded face configured to reduce injuries associated with impacting the article of furniture. In block 104, the components can packaged for shipment. For example, in some embodiments, to reduce shipping costs, the components are shipped in a disassembled state, e.g., as a "flat pack."

Although the corner protector has been disclosed in the context of certain preferred embodiments and examples, it will be understood by those skilled in the art that the corner protector extends beyond the specifically disclosed embodiments to other alternative embodiments and/or uses of the invention and certain modifications and equivalents thereof. For example, the extension portion 26 can include the opening 34 configured to receive a fastener. It should be understood that various features and aspects of the disclosed embodiments can be combined with or substituted for one another in order to form varying modes of the corner protector. Thus, it is intended that the scope of the corner protector herein-disclosed should not be limited by the particular disclosed embodiments described above, but should be determined only by a fair reading of the claims that follow.

What is claimed is:

1. A corner protector for a corner of an article of furniture, comprising:

a body configured to mate in a notch located at a corner of the article of furniture, the body having an upper surface, a first side, and a second side, wherein the upper surface intersects the first side and the second side in a proximal portion of the corner protector, and the first side intersects the second side;

a projection extending from the body along a longitudinal axis and configured to mate in a void in the article of furniture;

an extension portion extending from the upper surface generally away from the proximal portion, the extension portion configured to overlap a surface of the article of furniture; and a rounded corner configured to reduce injuries associated with impacting the article of furniture, the rounded corner disposed at the intersection of the upper surface, the first side, and the second side.

2. The protector of claim 1, wherein the first side and the second side are substantially orthogonal to each other and to the upper surface and a lower surface of the body.

3. The protector of claim 1, wherein the body further comprises a lower surface, the upper surface and the lower surface being substantially parallel.

4. The protector of claim 3, wherein the lower surface further includes a periphery having a radiused portion.

5. The protector of claim 1, wherein the projection further comprises an opening configured to receive a fastener.

6. The protector of claim 1, wherein the projection is substantially hollow.

7. The protector of claim 1, wherein the projection is substantially cylindrical.

8. The protector of claim 1, wherein the body further comprises one or more struts disposed in a cavity and configured to provide rigidity to the body.

9. The protector of claim 1, wherein the corner protector is a thermoplastic.

10. The protector of claim 1, wherein the extension portion contacts a top surface of the article of furniture.

11. A method of manufacturing a corner protector for an article of furniture having a top surface, comprising:

forming a body configured to mate in a notch in the article of furniture, the body having an upper surface, a first side, and a second side, wherein the upper surface intersects the first side and the second side in a proximal portion of the corner protector, and the first side intersects the second side;

forming a projection extending from the body along a longitudinal axis and configured to mate in a void in the article of furniture;

forming an extension portion extending from the upper surface generally away from the proximal portion, the extension portion configured to overlap the top surface of the article of furniture, the extension portion having a bevel configured to provide a generally smooth transition between the upper surface of the body and the top surface of the article of furniture; and forming a rounded corner configured to reduce injuries associated with impacting the article of furniture, the rounded corner disposed at the intersection of the upper surface, the first side, and the second side.

12. The method of claim 11, wherein an injection molding process forms one or more of the body, projection, and extension.

13. A method of manufacturing an article of furniture, comprising:

obtaining the components of an article of furniture, at least one of the components having at least one corner;

forming a notch in the at least one corner;

forming a void extending from the notch into the least one of the components;

positioning a protector in the notch, the protector comprising a rounded face configured to reduce injuries associated with impacting the article of furniture;

positioning a projection of the protector in the void; and packaging the components for shipment.

14. The method of claim 13, wherein forming the notch comprises routing the corner with a router.

15. The method of claim 13, wherein forming the notch comprises cutting the corner with a saw.

16. The method of claim 13, wherein the at least one corner is positioned at the intersection of at least three generally planar surfaces of the at least one component.

17. The method of claim 13, further comprising positioning an extension portion of the protector such that the extension portion is overhanging a top surface of the component of the article of furniture.

18. The method of claim 17, further comprising providing a bevel on the extension portion, the bevel configured to provide a generally smooth transition between an upper surface of the protector and the top surface of the at least one of the components.

19. The method of claim 18, further comprising securing the projection to the component with a fastener.

20. The method of claim 13, further comprising assembling the components to form the article of furniture.

21. The corner protector of claim 1, wherein the void extends from the notch.

22. The corner protector of claim 1, wherein the extension portion further comprises a bevel configured to provide a generally smooth transition between the upper surface of the body and a top surface of the article of furniture.

23. The corner protector of claim 1, wherein the corner is positioned at the intersection of at least three generally planar surfaces of the article of furniture.

24. The corner protector of claim 1, wherein the body is configured to substantially correspond with a size and shape of the notch.

25. The corner protector of claim 1, further comprising the article of furniture.

26. The method of claim 11, wherein the void extends from the notch in the article of furniture.

27. The method of claim 11, wherein the notch is located at a corner of the article of furniture.

28. The method of claim 27, wherein the corner is positioned at the intersection of at least three generally planar surfaces of the article of furniture.

* * * * *